United States Patent [19]

Ventavoli et al.

[11] Patent Number: 5,027,883

[45] Date of Patent: Jul. 2, 1991

[54] PROCESS AND DEVICE FOR THE CONTINUOUS CASTING OF THIN METAL PRODUCTS

[75] Inventors: Roger Ventavoli, Fameck; Daniel Neyret, Metz, all of France

[73] Assignee: Techmetal Promotion (Societe Anonyme), Maizieres-les-Metz, France

[21] Appl. No.: 503,700

[22] Filed: Apr. 3, 1990

[30] Foreign Application Priority Data

Apr. 6, 1989 [FR] France ..... 89 04861

[51] Int. Cl.[5] ..... B22D 11/16; B22D 27/02

[52] U.S. Cl. ..... 164/452; 164/468; 164/504; 164/154

[58] Field of Search ..... 164/468, 504, 452, 455, 164/154, 476, 417

[56] References Cited

FOREIGN PATENT DOCUMENTS 1583608 8/1970 Fed. Rep. of Germany .
2352611 12/1977 France .
60-148651 8/1985 Japan ..... 164/504

*Primary Examiner*—Kuang Y. Lin

*Attorney, Agent, or Firm*—Pollock, Vande Sande & Priddy

[57] ABSTRACT

The process for the continuous casting of thin metal products, particularly steel, products, of the type according to which the molten metal is poured into a continuous-casting ingot mold of elongated section, from which the partially solidified metal is continuously withdrawn and the thickness of the product emerging from the ingot mold is reduced by means of squeezing rolls (4, 4'), comprises the steps of (a) detecting whether the liquid phase tip is located upstream or downstream of the squeezing rolls, (b) applying between the squeezing rolls, a variable magnetic field to the core of the product, while matching the action of the magnetic field to the detected position of the liquid phase tip. The device for carrying out this process includes a coil assembly (7, 7') for detecting the bottom of the solidification pool, at least one inductor (6, 6'), housed in at least one of the squeezing rolls and capable of producing a variable magnetic field in the core of the cast product, and a DP unit 8 for making the action of the magnetic field dependent on the detected position of the liquid phase tip.

9 Claims, 1 Drawing Sheet

PROCESS AND DEVICE FOR THE CONTINUOUS CASTING OF THIN METAL PRODUCTS

FIELD OF THE INVENTION

The invention relates to the continuous casting of thin metal products, particularly steel products, and more particularly to the adjustment of the depth of the molten pool during casting in a machine comprising an ingot mold and squeezing rolls acting on the product while the latter is not entirely solidified.

PRIOR ART

Installations for the continuous casting of thin steel slabs are distinguished from installations for the continuous casting of slabs of standard thickness (of the order of 200 mm) particularly by the presence, below the ingot mold, of at least one pair of rolls, called squeezing rolls. In fact, the ingot mold, whose design is derived from that of ingot molds for conventional continuous casting, does not make it possible to obtain directly the small thicknesses desired (20 to 120 mm). In principle, the spacing between the squeezing rolls is fixed throughout casting and is equal to the thickness desired for the product. Their function is to bring together and join the solidified walls of the product emerging from the ingot mold so as to close the molten pool by anticipation.

When the squeezing rolls are located directly below the ingot mold, there is a risk, in the case in which the temperature of the molten metal feeding the machine is higher than envisaged, of a solidification of the metal which is not sufficiently advanced to guarantee the closing of the molten pool under the action of the squeezing rolls. Such delayed closing can give rise to the appearance of defects in the product, such as excessive segregations, bulging of the large faces, etc.

When the squeezing rolls are remote from the ingot mold the above-mentioned risk still exists. However, in that situation, the main danger is a premature closing of the molten pool which would occur upstream of the squeezing rolls due to too rapid a cooling of the product. In order to impose its definitive thickness on the product, the squeezing rolls must thus exert a true rolling force for which, in principle, they are not designed. Equipping the machine with a thickness reducing device which can exert such rolling forces in a lasting manner would considerably increase the cost of the installation.

SUMMARY OF THE INVENTION

The invention relates to a method and device for the rapid adjustment of the depth of the molten pool of the cast product, making it possible to avoid its delayed or premature closure.

To this end, the subject of the invention is a process for the continuous casting of thin metal products, particularly steel products, of the type according to which the molten metal is poured into a bottomless, cooled ingot mold defining a passage of elongated section for the cast product, from which the partially solidified metal is continuously withdrawn, and the thickness of the product emerging from the ingot mold is reduced by means of rolls, called squeezing rolls, located downstream of the ingot mold in the direction of withdrawal of the products. According to the invention, this process comprises the steps of (a) detecting whether the point of closure of the molten pool is located upstream or downstream of the squeezing rolls, and (b) applying, between the said squeezing rolls, a variable magnetic field to the core of the product, while making the action of said magnetic field dependent on the detected position of the liquid phase tip so as to prevent the molten pool from extending far downstream of the squeezing rolls.

The variable magnetic field may be stationary and exert a heating action on the cast product. It may also be mobile and exert a stirring action on the molten core of the cast product.

As will be understood, the invention consists in detecting whether the molten pool is closed upstream or downstream of the squeezing rolls and in modulating the amount of thermal or kinetic energy conveyed to the metal by the means for producing the variable magnetic field, so as to bring the liquid phase tip back between the squeezing rolls.

Instruments capable of detecting the presence or the absence of a zone which is still molten at the core of a product being cast are already known. Some of these are ultrasound probes consisting in producing an ultrasound wave which propagates transversely through the product to be analyzed. The transmitted energy is detected and compared with a reference value determined in the absence of a molten pool. A similar principle may be applied with the aid of induction coils, the strength then varying as a function of the presence or absence of a molten phase at the core of the product. These instruments are quite suitable for thin products, such as those in question here. However, other devices which are better adapted to thicker products may, of course, also be suitable, e.g., the one disclosed in Certificate of Utility No. FR 2352611, which detects a variation in thickness in a conventional slab, continuously cast between two pairs of rolls, due to bulging caused by the molten core, by measuring the differential absorption of an alternating magnetic field passing through the product in the direction of its thickness.

Moreover, the speed of solidification of a product being cast, which influences the depth of the molten pool, may be modified by setting up forced convection movements within the molten core, particularly if the product is thin. The more intense these movements, the more rapid the solidification. The movements may be produced by the action of mobile, variable magnetic fields created by inductors. These inductors may advantageously be located inside the squeezing rolls themselves. Finally, the speed of solidification of the product may be influenced by the application of a stationary, variable magnetic field having an inductive heating effect on the product. The more intense this heating, the more solidification is delayed.

BRIEF DESCRIPTION OF THE DRAWINGS

The invention will be better understood by referring to the following description which is made with reference to the accompanying drawings, in which.

DESCRIPTION OF THE PREFERRED EMBODIMENT

Figure 1:
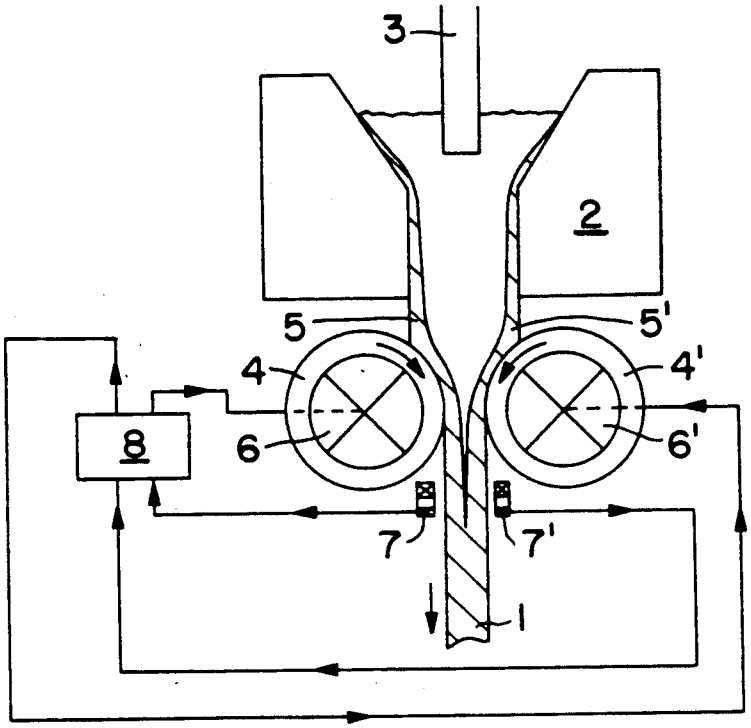
FIG. 1 is a schematic view, partly in section, of an installation for the continuous casting of thin slabs according to the invention, in which the squeezing rolls are located immediately below the ingot mold.

In FIG. 1, the product 1 emerges from the ingot mold 2, fed with molten metal via the nozzle 3, in a partially solidified state. In the example shown, the squeezing rolls 4, 4', which bring closer together the layers of solidified metal 5, 5' forming the large faces of the product so as to close the molten pool, are located just below the ingot mold. They each contain an inductor (6, 6') generating a variable magnetic field. For this reason, these rolls are hollow and advantageously in accordance with those described in Luxemburg Pat. No. 67 753, the contents of which are incorporated by reference in the present description. If, as shown, the solidification of the product is too slow, the action of the squeezing rolls is insufficient to close the molten pool. This is reflected in a bulging of the product downstream of the squeezing rolls. In the example in question, this bulging is detected by the assembly formed by the coils 7, 7', as indicated in the already mentioned Certificate of Utility No. FR 2352611: the field generated by the transmitting coil 7 is partially received by the receiving coil 7'. The value of the received signal is correlated, by a data-processing unit 8, with the thickness of the product, which is itself compared with the nominal thickness thereof. If the measured thickness is greater than the nominal thickness, this reflects the existence of a molten pool which is extended abnormally below the squeezing rolls. Consequently, the data-processing unit commands modification of the action of the magnetic fields generated by the inductors 6, 6'.

If the magnetic fields are mobile, their stirring action on the molten core may be permanent and may play a part in the normal solidification process of the product. It is then necessary to increase the intensity of the stirring so as to accelerate solidification and to bring the liquid phase tip back between the squeezing rolls. A return to this normal situation is reflected in the disappearance of bulging below the squeezing rolls. Another possibility consists in producing the stirring action only if the solidification pool descends below the squeezing rolls. This action is interrupted as soon as the bottom of the solidification pool returns to its normal location.

If the magnetic fields are fixed, their action of heating the product is permanent and makes it possible to modulate the speed of solidification of the product. In order to raise the liquid phase tip, it is then necessary to reduce or interrupt this heating action.

The coils 7 and 7' may be replaced by any other device which makes it possible to detect the molten pool, such as ultrasound transducers, for example.

Figure 2:
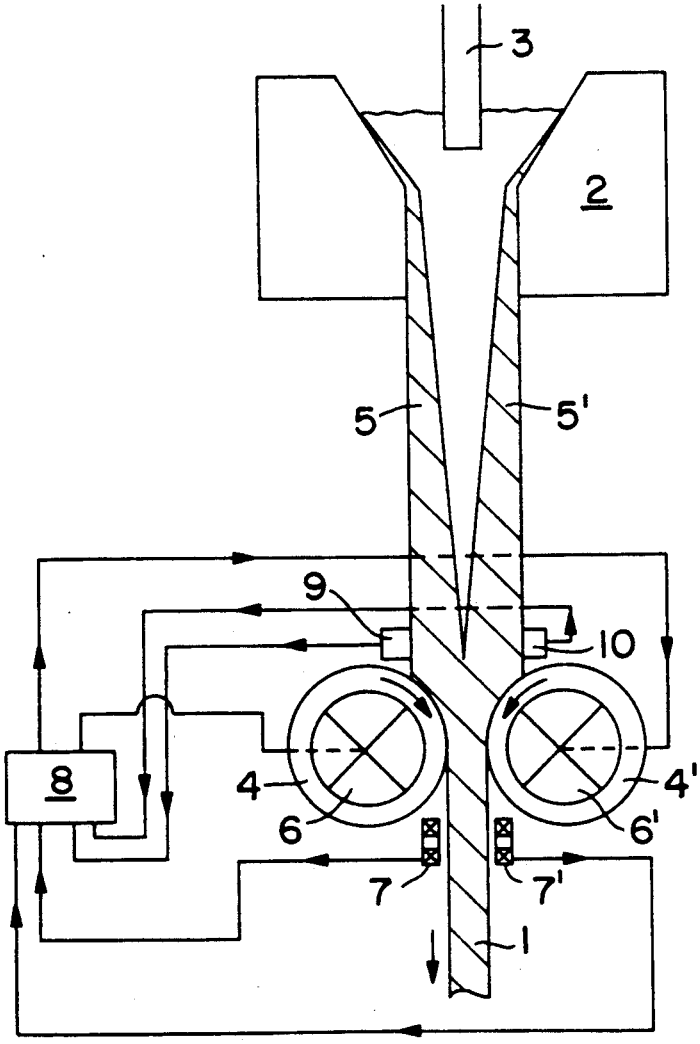
FIG. 2 is a view similar to FIG. 1, in which the squeezing rolls are remote from the ingot mold.

If the continuous-casting machine comprises squeezing rolls which are distant from the ingot mold, for example by a distance of approximately 1 m, as shown in FIG. 2, it is also possible, as above, to use an assembly composed of coils 7, 7' in order to detect delayed closure of the molten pool. However, in this type of installation, the main risk is of the premature closure of the molten pool upstream of the squeezing rolls due, for example, to an abnormally low temperature of the molten metal feeding the ingot mold. It is then necessary to supplement the device for detecting the molten pool located below the squeezing rolls with a device which is capable of detecting a closure of the molten pool taking place upstream of the squeezing rolls. As shown in FIG. 2, this device may consist of an assembly of ultrasound transducers, a transmitter 9 and a receiver 10 located against the advancing product and connected to the processing unit 8. The transducers are calibrated so that it is possible to determine whether the core of the product is in the molten state, as required by the normal operation of the machine. In the opposite case, the processing unit commands modification of the action of the inductors incorporated in the squeezing rolls. If this action is a permanent stirring action, it is reduced or even interrupted so as to slow down solidification. If this action is a heating action, it is increased if it is permanent, or triggered if it is only intermittent, and intended precisely to liquefy the core of a product which, without this, intervention would already be at least partially solidified.

The molten pool may be detected by means of any device other than those mentioned. Similarly, the inductors do not have to be housed in the rolls. If sufficiently powerful inductors are available, it is quite possible to dispose them outside the rolls if desired. Similarly, again in the case of a machine with squeezing rolls which are distant from the ingot mold, it may be designed to operate so as to minimize the risk that the liquid phase tip will appear below the squeezing rolls, thus obviating the need for a device for detecting the pool in this zone.

We claim:

1. In a process for continuous casting of a thin metal product, comprising the steps of (a) pouring molten metal into a bottomless, cooled ingot mold (2) which defines a passage of elongated section for a cast product;

(b) continuously withdrawing from said ingot mold a partially solidified cast product;

(c) reducing a thickness of said cast product emerging from said ingot mold by means of squeezing rolls located downstream of said ingot mold in a direction of withdrawal of said cast product;

the improvement comprising the steps of (d) detecting whether a liquid phase tip is located upstream or downstream of said squeezing rolls; and (e) applying a variable magnetic field to a core of said product between said squeezing rolls (4, 4'), while making the action of said magnetic field dependent on a detected position of said liquid phase tip, so as to prevent said liquid phase from extending far downstream of said squeezing rolls.

2. The improvement claimed in claim 1, wherein said magnetic field is a stationary variable magnetic field having an inductive heating effect on said product.

3. The improvement claimed in claim 1, wherein said magnetic field is a mobile variable magnetic field having a stirring effect on a molten core of said product.

4. Apparatus for the continuous casting of a thin metal product of the type comprising a bottomless, cooled ingot mold (2) defining a passage of elongated section for a cast product and, downstream of said ingot mold in a direction of withdrawal of said product, squeezing rolls (4, 4') for reducing a thickness of said product in order to effect closure of a solidification pool, said apparatus comprising (a) means (7, 7'; 9, 10) for detecting a location of a liquid phase tip of said product adjacent said squeezing rolls;

(b) at least one inductor (6, 6') capable of producing a variable magnetic field in a core of a cast product located between said squeezing rolls; and (c) means (8) for matching said at least one inductor to said means for detecting the location of said liquid phase tip, in order to bring or maintain said liquid phase tip between said squeezing rolls.

5. The apparatus claimed in claim 4, wherein said variable magnetic field is a stationary magnetic field exerting a heating action on said cast product.

6. The apparatus claimed in claim 4, wherein said variable magnetic field is a mobile magnetic field exerting a stirring action on said molten core of said cast product.

7. The apparatus claimed in claim 14, wherein said means for detecting said liquid phase tip consist of ultrasound transducers.

8. The apparatus claimed in claim 14, wherein said means for detecting said liquid phase tip consist of induction coils.

9. The apparatus claimed in claim 14, wherein said inductor (6, 6') is housed inside said squeezing rolls (4, 4').

* * * * *